US005311724A

United States Patent [19]

Vernon et al.

[11] Patent Number: 5,311,724

[45] Date of Patent: May 17, 1994

[54] COLLATING APPARATUS

[75] Inventors: Geoffrey W. Vernon, Kenilworth; James Goodwin, Coventry; David Seaward, Kingshurst; Thomas W. Bailey, Berkswell, all of Great Britain

[73] Assignee: Thomas J. Lipton Co., Division of Conopco, Inc., Englewood Cliffs, N.J.

[21] Appl. No.: 67,410

[22] Filed: May 26, 1993

Related U.S. Application Data

[63] Continuation of Ser. No. 801,325, Dec. 2, 1991, abandoned.

[30] Foreign Application Priority Data

Nov. 30, 1990 [GB] United Kingdom ..... 9026124.9
Jun. 19, 1991 [GB] United Kingdom ..... 9113197.9

[51] Int. Cl.[5] ..... B65B 35/50

[52] U.S. Cl. ..... 53/529; 53/54; 53/157; 53/251; 53/535; 53/540

[58] Field of Search ..... 53/54, 53, 55, 535, 53/540, 447, 529, 157, 156, 531, 250, 251, 249, 253, 255; 414/790.8, 789.5, 790.2, 790.3

[56] References Cited

U.S. PATENT DOCUMENTS

| | | | |
|---|---|---|---|
| 3,526,170 | 9/1970 | Oderman et al. . | |
| 3,745,740 | 7/1973 | Williams | 53/535 X |
| 3,876,083 | 4/1975 | Evans et al. | 271/214 X |
| 4,079,569 | 3/1978 | Molins | 53/540 X |
| 4,182,237 | 1/1980 | O'Brien | 53/529 X |
| 4,492,070 | 1/1985 | Morse et al. | 53/529 X |
| 4,613,033 | 9/1986 | Focke et al. | 198/457 |
| 4,899,518 | 2/1990 | Beeman et al. | 53/540 X |
| 5,012,628 | 5/1991 | Van Oord | 53/535 X |

FOREIGN PATENT DOCUMENTS

| | | |
|---|---|---|
| 574447 | 3/1984 | Australia . |
| 0036398 | 9/1981 | European Pat. Off. . |
| 0059840 | 5/1985 | European Pat. Off. . |
| 0302543 | 2/1989 | European Pat. Off. . |
| 0312490 | 4/1989 | European Pat. Off. . |
| 0390246 | 10/1990 | European Pat. Off. . |
| 3239860 | 10/1981 | Fed. Rep. of Germany . |
| 3708604 | 9/1988 | Fed. Rep. of Germany . |
| 3736868 | 5/1989 | Fed. Rep. of Germany . |
| 4017692A1 | 12/1991 | Fed. Rep. of Germany . |
| 1393819 | 4/1964 | France . |
| 8200397 | 9/1983 | Netherlands . |
| 219202 | 7/1988 | New Zealand . |
| 700930 | 12/1953 | United Kingdom . |
| 2156766A | 10/1985 | United Kingdom . |
| 2165203A | 4/1986 | United Kingdom . |
| 2165203 | 4/1986 | United Kingdom . |
| 2184088 | 6/1987 | United Kingdom . |
| 2201934 | 9/1988 | United Kingdom . |

OTHER PUBLICATIONS

EP Search Report EP 91 31 1128.
Australian Search Report (Jun. 24, 1993).

*Primary Examiner*—James F. Coan
*Attorney, Agent, or Firm*—James J. Farrell

[57] ABSTRACT

Collating apparatus for stacking generally flat articles comprises a chute on opposite sides of which are two pairs of conveyor bands carrying supports for the articles. The conveyor bands are driven as two diagonally opposite pairs so that the stack builds on the supports of one pair of bands while a preceding stack built on the supports of the other pair of bands is discharged from the chute. The supports carried by the bands also comprise members which act on the completed stack to compress it before it is discharged.

16 Claims, 6 Drawing Sheets

COLLATING APPARATUS

This is a continuation application of Ser. No. 07/801,325 filed Dec. 2, 1991, now abandoned.

BACKGROUND OF THE INVENTION

The present invention relates to collating apparatus for forming a stack or row of similar articles, especially articles having a generally flat configuration.

Continuous processes producing a series of individual articles at a high rate usually require means for collating the articles at the end of the production line in an orderly manner prior to packaging them for distribution. EP-A-0059840 and DE-A-3708604 for example, disclose collators which collect flat packets of uniform size in stacks having a specified number of packets.

Thus, in DE-A-3708604 a collator has a chute provided with cantilevered platforms which travel downwards past the end of the horizontal conveyor belt from which the articles tip onto the platforms. The rate of delivery of the products is synchronised with the speed of descent of the platforms. A horizontal pusher below the conveyor belt has its movement coordinated with the movement of the platforms to clear the stack which has been completed on each platform as its descends to the level of the pusher. Such an arrangement is limited in its rate of operation, especially in handling flat products, e.g. because the rate of delivery of the product must not exceed the capacity of the pusher to move the stacks stably without obstructing the regular delivery of further articles to the collator.

In DE-A-3736868 the stack of articles is built on a chute, similarly provided with cantilevered support platforms. In one arrangement the stack is built on such platforms which are mounted on circulatory bands that progressively lower the platforms to maintain the top of the building stack at a constant height, and a corresponding second set of platforms on circulating bands is disposed below the first. As it is completed the stack of articles is dropped from the first set of platforms to the second set and the second set then lower the stack to a position in which an extractor device can be inserted into the chute to expel the stack. The second set of platforms acts as a buffer to hold the completed stack while the next stack begins to build.

This arrangement is also limited in its speed of operation and has a number of other significant disadvantages. The transfer of the completed stack and the return of the first set of platforms to a stack-building position takes a certain amount of time and this must not exceed the rate of delivery of the articles. Furthermore, this time period will increase with the height of the stack. The stack must then fall under gravity onto the second set of supports without disruption and this can pose an even more severe limitation on the height of the stack.

In all these chute-like arrangements for forming a stack there is also the problem that the articles will often be easily deformable and if packed as a free-standing stack they will move in the container, becoming disordered and even being damaged. It is therefore desirable to pack the stacks in a slightly compressed state, but an additional operation is needed for this, after the stack has left the collating apparatus.

SUMMARY OF THE INVENTION

According to one aspect of the present invention, a collating apparatus for a stack of generally flat articles comprises a downwardly extending guide for containing the articles as they are stacked together, support means within said guide extending downwardly from an upper entry region of the guide and displaceable with the accumulation of said articles within the guide to at least partly compensate for the increasing height of said accumulating articles, the support means comprising a plurality of overlapping support arrangements for respective stacks of articles and means for driving said support arrangements at different rates from each other.

With such apparatus, successive stacks can be built without interruption, and the manner in which completed stacks are discharged need not limit the maximum rate of operation.

According to another aspect of the invention collating apparatus for a stack of generally flat articles comprises a downwardly extending guide for containing the articles as they are accumulated in a stack, support means within said guide extending downwardly from an upper entry region of the guide and displaceable with the accumulation of said articles within the guide to at least partly compensate for the increasing height of the accumulating stack, and means are provided for engaging the top of the completed stack prior to its removal from the guide to compress the height of the stack before it is removed from the guide. By compressing the stack after it has been completed and before it is discharged there is further scope for increasing the rate of operation as well as achieving a simplification of the apparatus.

It may be appreciated that the compression of the completed stack before discharge is a function for which an arrangement having overlapping support arrangements as aforesaid is well adapted.

As a further measure to permit high rates of delivery of the articles, the apparatus may be provided with transfer means for packing the stacks and arranged to receive a stack from the chute at the same time as a preceding stack is being packaged.

Embodiments of the invention will now be described with reference to the accompanying drawings.

DESCRIPTION OF THE PREFERRED EMBODIMENT

Figure 1:
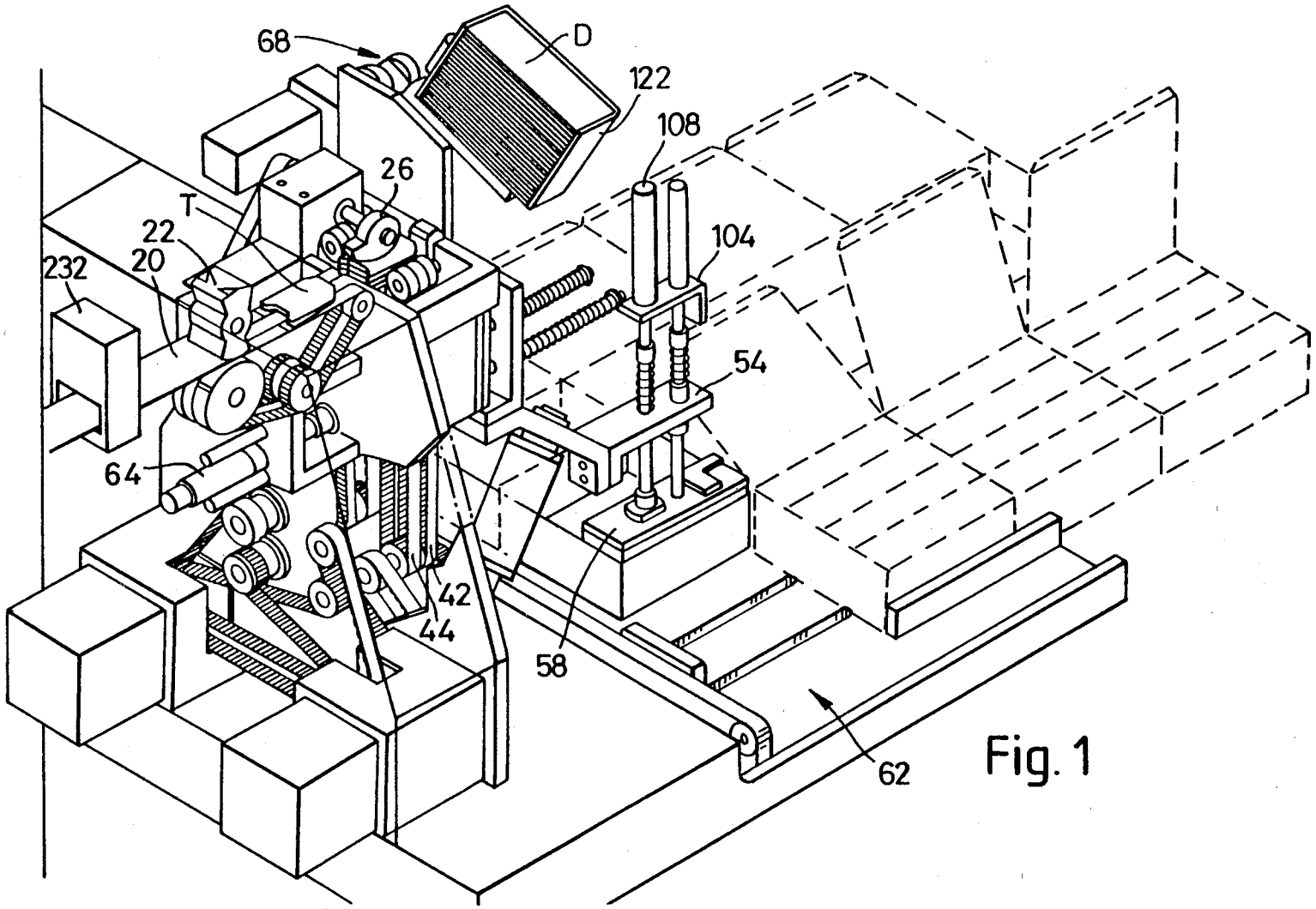
FIG. 1 is an isometric view showing a collator according to the invention operating to assemble stacks of articles in the form of flat packets.

The apparatus illustrated comprises a vertical guide chute 40 fed with packets in the form of tea bags T from a horizontal conveyor 20 which has a rotary spacer 22 to set the packets at a uniform spacing so that they are delivered to the chute at regular intervals. At the top of the chute a tamper 26 is mounted on a horizontal rotary axis extending transverse to the conveyor, to drive each packet down into the chute. The tamper is in the form of a rotor body having a radial cross-section which is circular for slightly more than three quarters of its circumference, the curvature then changing to form a wing with an increasing radial depth over the remaining part of its circumference, giving a spiral profile. The tamper rotates in a counter-clockwise direction as seen in FIGS. 1 and 2 and pushes each packet down a distance considerably greater than the thickness of the packet.

The chute comprises four stack separator belts 42,44,46,48 each of which is a continuous belt extending vertically between its own pair of top and bottom rollers. The belts are arranged in pairs 42,44 and 46,48 on opposite sides of the chute bounding a rectangular planform central space into which the tamper 26 drives the tea bags T. They are driven so that the belt runs that face the central space move downwards. The belts carry cantilevered plates 50 which hold the tea bags T in a stack within the chute. The spacing between the opposed pairs of belts is slightly greater than the corresponding width of the tea bags so that the bags can move downwards freely with the plates 50.

As a stack of a given number of tea bags is completed in the chute it is ejected by a pusher mechanism 52 onto a transfer arm 54 which is mounted on an axis 56 inclined at 45° to the chute and which has two diametrically opposite carriages 58. The transfer arm can be rotated by a motor 60 to move each carriage, between a vertical position adjacent the chute and a horizontal position over a carton filling conveyor 62. In its vertical position each carriage 58 is able to receive a stack of tea bags from the chute. In its horizontal position it deposits the stack into an open carton C which has been inserted into the conveyor.

Figure 2:
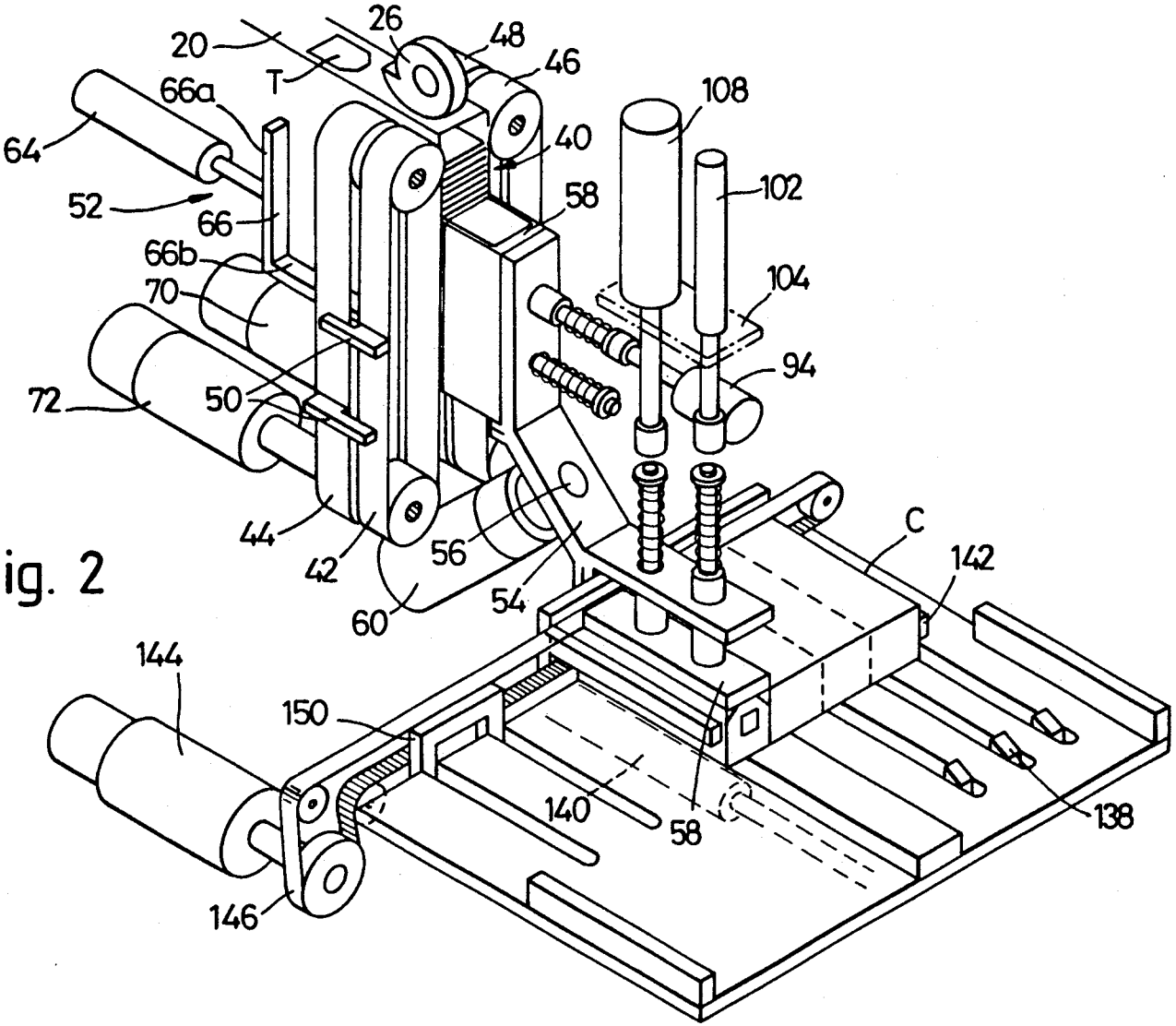
FIG. 2 is another isometric view showing in more detail the interaction of the collator chute and the transfer arm for removing a stack of packets from the chute.

The pusher mechanism 52 comprises a ram 64 and an L-shaped pusher 66 which are shown in FIG. 2 withdrawn from their normal working state for better illustration of the pusher. In the working state, with the ram 64 contracted, the vertical limb 66*a* of the pusher lies at the side of the chute immediately adjacent the stack building in the chute, while the horizontal bottom limb 66*b* projects into the chute under the stack, lying between the paths of movement of the plates 50 on the belts. Extension of the ram 64 projects the pusher 66 with a completed stack of tea bags into the waiting, vertically oriented carriage 58 and the stack is retained in the carriage when the pusher is again retracted.

The machine also has a feeder unit 68 (FIGS. 1 and 6) for divider cards D that are fed to the carriages, while they are vertical and adjacent the chute, to be placed between successive stacks of tea bags in the cartons.

Each of the separator belts has four of the cantilevered plates 50 at spaced positions along its length. The plates on each belt are grouped in pairs consisting of a support plate on which a stack builds and a clamping plate which compresses the completed stack before its discharge. As can be best seen in FIG. 2, each plate projects from its belt over most of the width of the laterally adjacent belt, but there is a central gap in the chute between the paths of circulation of the plates to leave clearance for the pusher 66.

On each side of the chute, the pairs of upper and lower rollers of the two belts are mounted coaxially but independently of each other. The belts are driven by two motors 70,72, each of which is coupled to a diagonally opposite pair of belts 42,48 and 44,46 respectively and drives its pair of belts so as to maintain the plates 50 of the two belts in register. The motors can drive the two pairs of belts of different rates so that they act in alternation, as will be made clearer below, but their relative movements are coordinated to prevent contact between the plates 50 of the respective pairs of belts. Successive stacks are thereby built on the support plates 50 of alternative pairs of diagonally opposite belts. While a stack is being built on a pair of plates those plates move downwardly to maintain the top of the building stack at substantially a constant height.

Figures 3A, 3B, 3C, 3D, 3E:
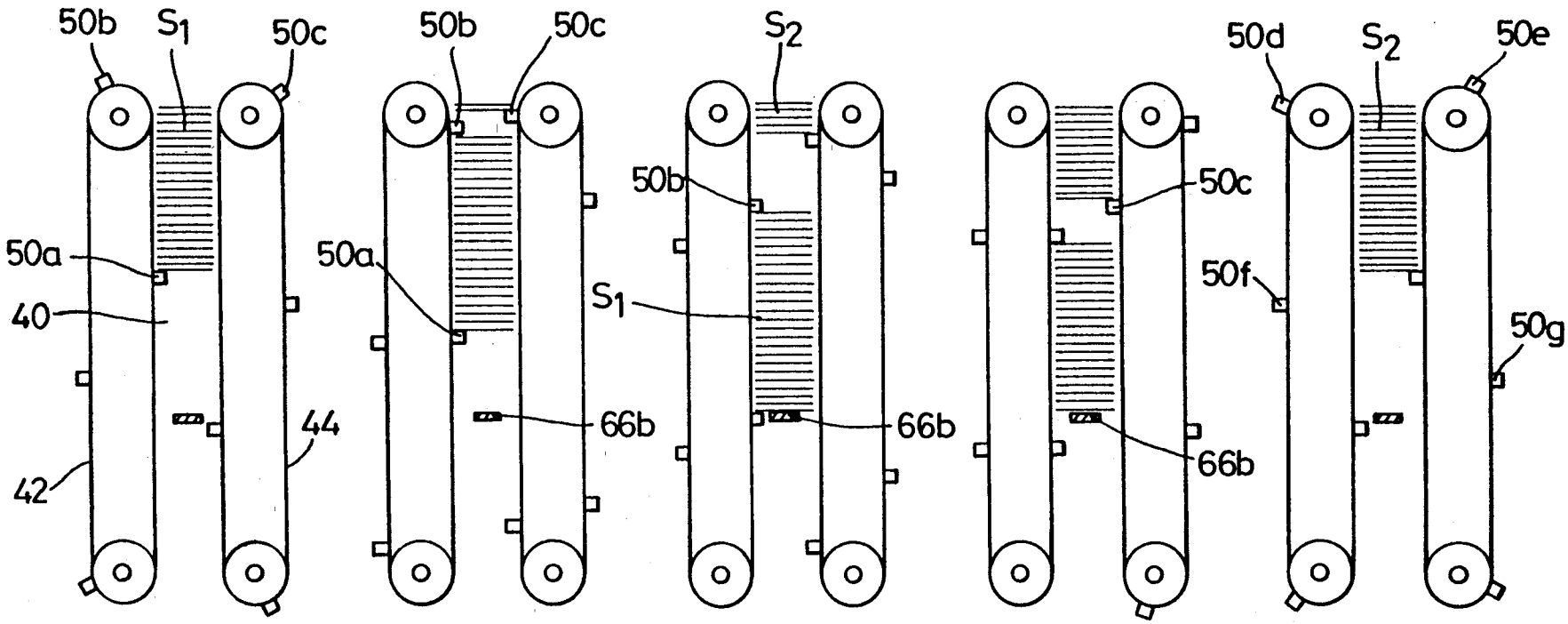
FIGS. 3*a–e* is a series of schematic views illustrating a cycle of operations in the chute.

The sequence of operations in building the stacks in the collator is illustrated schematically in FIG. 3. In each view of FIG. 3 only one belt 42,46 of each of the two diagonally opposite pairs 42,48 and 44,46 can be seen, and the cantilevered plates 50 of each are distinguished by references 50*a* to 50*f* to explain their functions more clearly. In FIG. 3*a*, the stack $S_1$ resting on a first pair of plates 50*a* of the pair of belts 42,48 has been almost completed while those belts 42,48 move to lower the operative supporting plates 50*a* progressively to maintain the top of the stack at the same height.

With the completion the stack, both pairs of belts are accelerated: the succeeding plates 50*b* of the belts 42,48 move below the packet entry station at the top of the chute while a pair of supporting plates 50*c* of the other pair of belts 44,46 move into an operative position at the entry station (FIG. 3*b*). The uninterrupted stream of tea bags therefore begins to build a further stack $S_2$ on the plates 50*c*, which are now lowered at a slower rate to maintain the top of the stack $S_2$ at a substantially constant height. The positioning of the supporting plates 50*c* and the lowering of the completed stack $S_1$ are completed sufficiently quickly to ensure that the feed of tea bags need not be interrupted.

The accelerated motion of the belts 42,48 has meanwhile been extended to lower the stack $S_1$ rapidly onto the pusher horizontal limb 66*b* (FIG. 3*c*). This also brings clamping plates 50*b* of the same belts onto the top of the stack whereby the stack is compressed between the limb 66*b* and the plates 50*b* (FIG. 3*c*).

With the stack $S_1$ held between the limb 66*b* and the plates 50*b*, the movement of the belts 42,48 is stopped (FIG. 3*d*) in preparation for the discharge of the first stack. The belts 42,48 have a stationary dwell period of about 0.3 s to hold the stack compressed by the plates 50*b* as it is ejected. Sufficient space is left in the chute for the progressive downward movement of the stack $S_2$ on the supporting plates 50*c* for this dwell period while the first stack is being ejected to a carriage 58, as will be described below.

A corresponding set of movements are made for the discharge of the second stack. Thus, after the first stack $S_1$ has left the chute and as the second stack $S_2$ is being completed, the first pair 42,48 of belts is accelerated to bring its other pair of supporting plates 50*d* to a position of readiness (FIG. 3*e*) corresponding to that shown for the supporting plates 50*c* in FIG. 3*a*. This accelerated movement is continued during the completion of the second stack $S_2$ and its movement to the discharge position, with compression by the clamping supports 50*e*. This sequence, and the ejection by the pusher 66, takes place in the same manner as for the first stack.

Without interruption, a further stack again begins to be built up, now on the supports 50*d* of the first pair of belts 42,48, which move into an operative position at the top of the chute as soon as the second stack is lowered to its discharge position. The stack on the plates 50*d* is similarly completed, compressed by the plates 50*f* and discharged, and after the building of the next stack in the same way on the supporting plates 50*g* of the belts 44,46, the supporting plates 50*a* move into the operative position again. The cycle illustrated can then be repeated.

Figure 5:
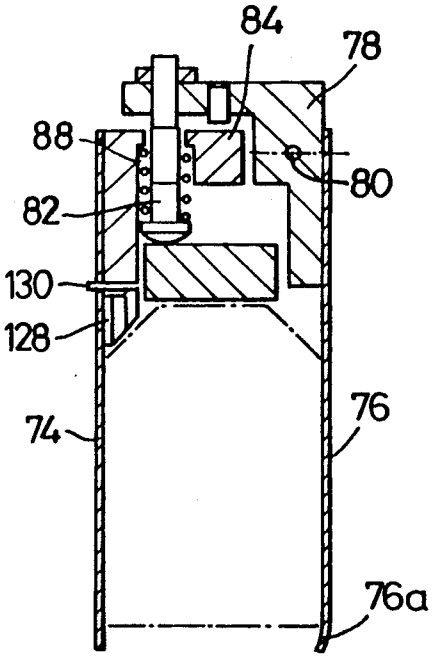
FIGS. 4 and 5 are mutually perpendicular sectional views showing details of a transfer arm carriage.
Figure 4:
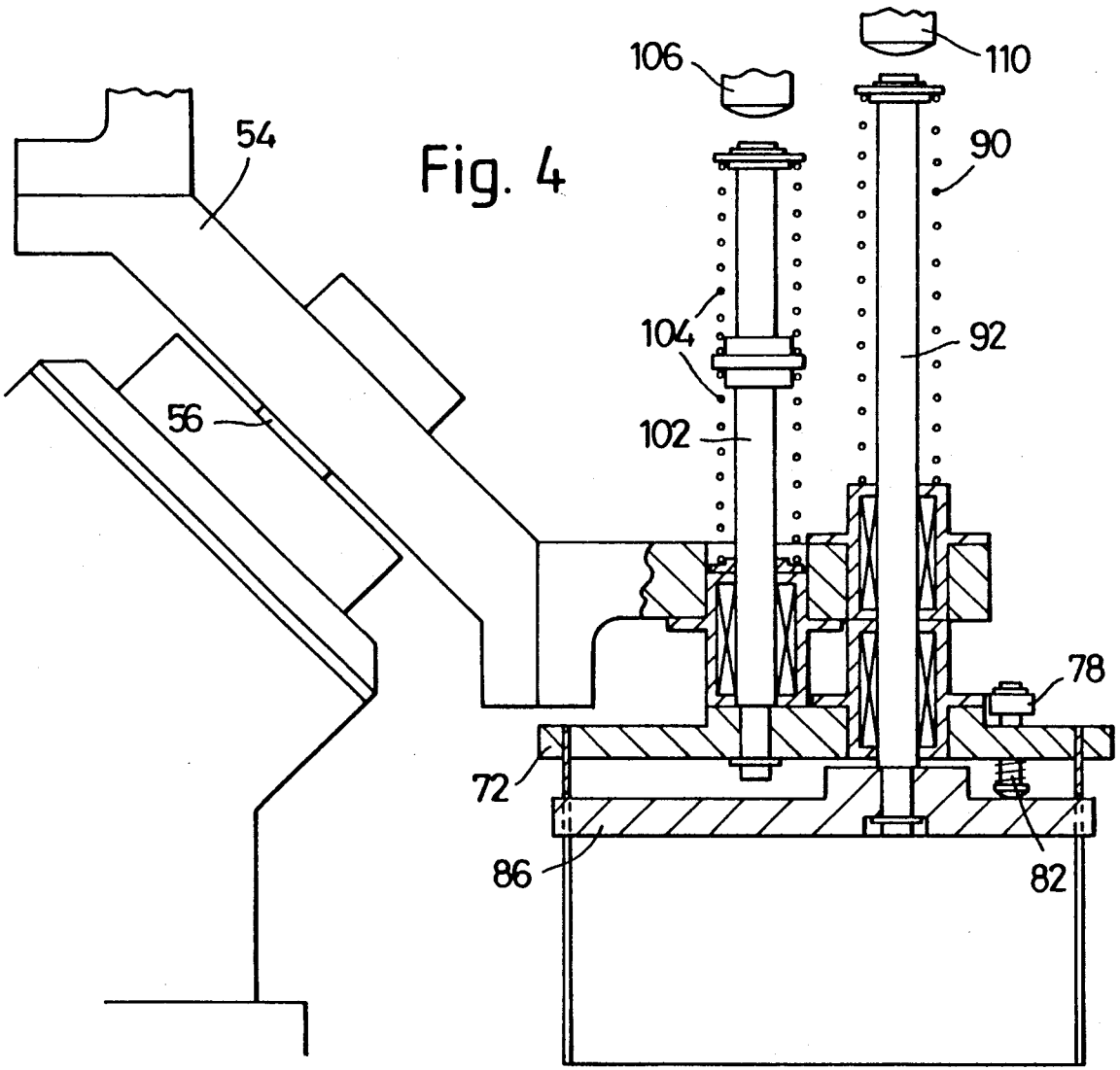

The two diametrically opposite carriages 58 on the transfer arm 54 are identical to each other. Their features are shown in more detail in FIGS. 4 and 5. Each comprises a box-like receiver of rectangular form having a back plate 72 from which side plates extend. The longer sides are formed by generally parallel plates 74,76, the former fixed to the back plate and the latter being mounted on a crank arm 78 to be pivotable on a hinge pin 80 away from the plate 74. A pin 82 projecting slidably through the back plate 72 is attached to the crank arm 78 and is urged against a presser plate 86 in the carriage by a light spring 88. The presser plate 86 is normally held in its inner position illustrated in FIG. 4 by a stronger spring 90 acting through rod 92 on the pressure plate 86.

When their carriage is in the vertical position in preparation for receiving a completed stack, the plates 74,76 are located adjacent the chute in vertical planes close to planes of the inner runs of the belts 42–48. As an initial step in the transfer of the stack to the carriage, the plate 76 is pivoted slightly away from the plate 74 by a fixed position ram 94 or a cam-like abutment adjacent the chute. The ram 94 acts through the rod 92 to displace the presser plate 86 forwards slightly and so allows a corresponding extension of the spring 90.

When a compressed stack is already held in the collator, as described above, the extension of the ram 64 carries the stack, still supported on the pusher limb 66*b*, into the vertically oriented carriage. Because the plate 76 has already been pivoted away from the plate 74 there is no resistance to the stack sliding between the plates 74,76. As the limb 66*b* is retracted the ram 94 also retracts and the plate 76 returns to grip the stack. If, alternatively the plate 76 has been displaced by a fixed abutment, this is disengaged as the carriage begins to move away from the chute. The pivotable plate 76 has an inturned lip 76*a* near its outer edge to ensure that the stack of tea bags can be securely held between the plates 74,76 when the limb 66*b* retracts. The transfer arm 54 then pivots through 180° to position the carriage over the carton C.

When the carriage reaches the carton conveyor 62 the plates 74,76 are again vertical and are directed downwards towards the interior of the carton. The carriage 58 is supported on the transfer arm 54 primarily through a rod 102 which is slidably mounted on the carriage and urged to an end position by springs 104. In the downwardly directed position of the carriage, the rod 102 has come into register with a ram 106 on a fixed bracket 108. By extension of the ram 106 the carriage is lowered, with the stack of tea bags, into the carton. A further ram 110, mounted on the bracket 108 parallel to the ram 106 is extended immediately after to follow the movement of the rod 92 secured to the pusher plate 86 parallel to the rod 102. The ram 110 does not displace the plate 86 relative to the carriage body, however.

The ram 106 now retracts, allowing the springs 104 drive the rod 102 to lift the carriage 58 out of the carton. The ram 110 remains extended, however, and prevents the presser plate 86 from rising with the carriage so that the tea bags are forced to remain in the carton. Because the presser plate is held back as the carriage rises, the spring 88 is able to pivot the plate 76 to release the tea bags from between the plates 74,76. When the ram 110 is retracted, therefore, the plate 76 is already clear of the tea bags in the carton before the pin 82 is engaged to restore its position.

Figure 6:
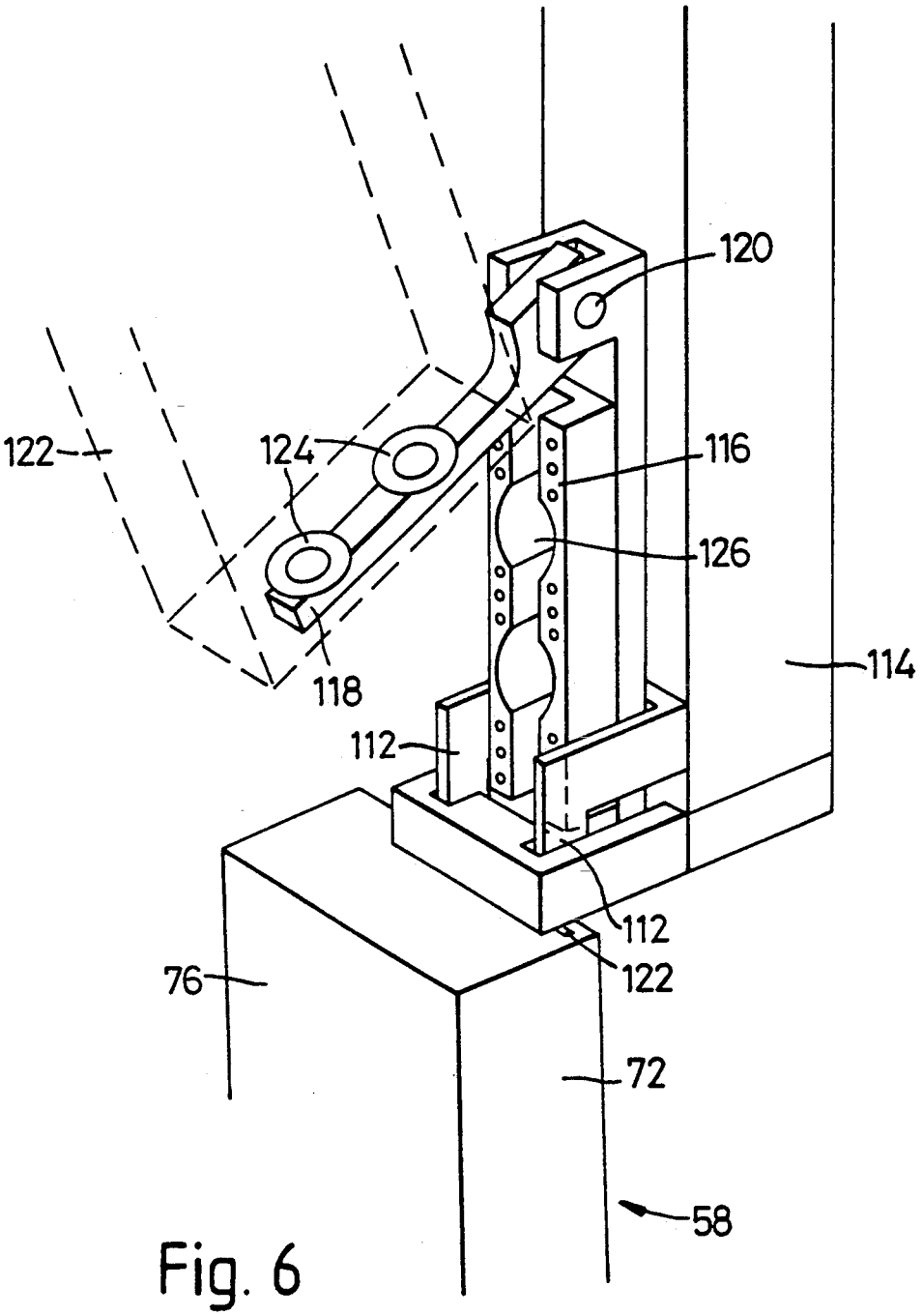
FIG. 6 illustrates a feeder unit for dispensing divider cards when the packets are packed in multiple stacks.

Before each carriage 58 receives a stack of tea bags from the chute, a divider card D can be supplied to it from the feeder unit 68. Referring mainly to FIG. 6, the unit comprises a pair of insertion arms 112 which are vertically reciprocable, e.g. by a rodless pressure cylinder 114. A suction manifold block 116 has a feeder member 118 mounted on it through a pivot joint connection 120. Between the feeder member and a fixed card magazine 122 a ram (not shown) is connected and operates to pivot the member 118 on its joint 120. The feeder member is provided with suction cups 124 and can be swung by the ram between the illustrated position, in which the suction cups are brought against a bottom card in the magazine 122, and a retracted position in which the cups 124 are withdrawn into recesses 126 in the fixed manifold block.

With the suction cups 124 placed against a bottom card in the magazine and the insertion arms 112 lifted from the illustrated position to a raised position adjacent the pivot connection 120, a vacuum is applied to the cups, and the card is extracted as the feeder member 118 swings down and is brought against the manifold block 116. Suction is now applied to apertures in the manifold block instead of the suction cups as the insertion arms 112 are lowered to slide the card down the manifold block and through an aligned slit 122 adjacent the fixed side plate 76 in the uppermost face of the carriage 58 waiting in its vertical position.

The card is initially held in the carriage by its inner edge in a slot 128 between the plate 74 and the bracket 84. Pins 130 project from the presser plate 86 behind the slot and are aligned with slits (not shown) in the walls of the slot 128. When, during the transfer of the stack of tea bags into the carton, the plates 74,76 retract relative to the pusher plate 86, the pins 130 detain the divider card D so that it is deposited in the carton with the stack of tea bags.

In the carton filling conveyor 62, retractable pawls 138 are reciprocable towards and away from the transfer arm, by pressure cylinder 140, to place the carton C in a carrier 142 mounted on a slide (not shown). A motor 144 operates through a belt drive 146 to index the carrier and thus the carton in synchronism with the movements of the transfer arm 54 to present a fresh space in the carton to each stack of tea bags until the carton is filled. The feed of the divider cards D is controlled so that no card is dispensed for the first stack of tea bags to be inserted in a carton. With each subsequent stack a card is dispensed and is placed between that stack and a preceding stack in the carton. After a final indexing movement of the filled carton it is discharged from the filling conveyor 62 by the pressure cylinder 140 acting through an ejector plate 150. The carrier is re-indexed in readiness for the next carton to be filled which is then brought into the zone of action of the transfer arm by the cylinder 140 acting through the pawls.

Figure 7:
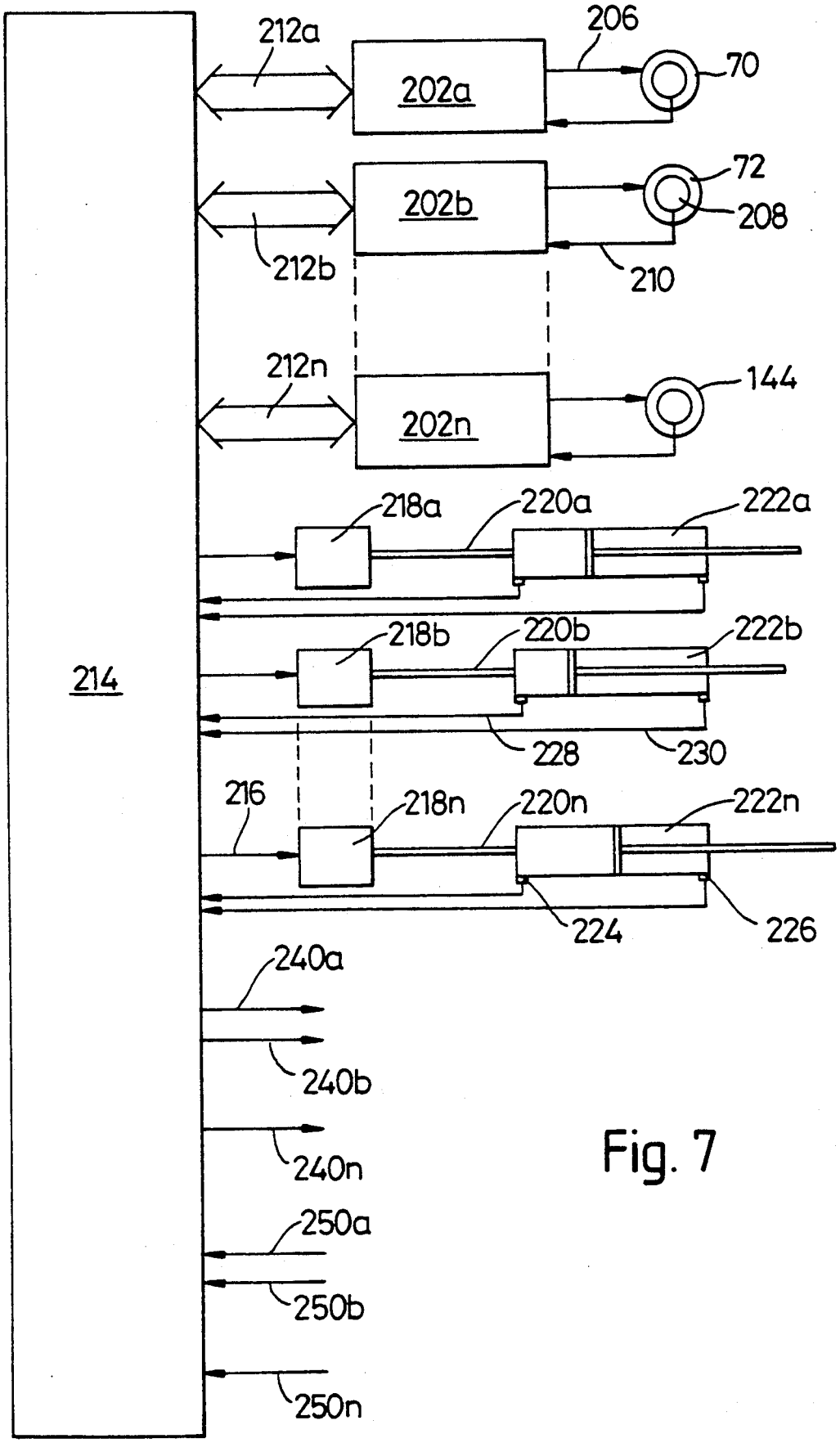
FIG. 7 is a block diagram of the control means for operating the collator.

A schematic illustration of the means for controlling and coordinating the operation of the apparatus is illustrated in FIG. 7. Respective electrical servo-units 202a,202b . . . 202n control the movement of the electric motors in the apparatus, here exemplified by the chute belt motors 70,72 and the carton indexing motor 144. Each servo-unit has an output 206 for driving its motor and each motor being provided with an incremental encoder 208 generating a feedback input 210 into the servo-unit to indicate the position of the motor or a member controlled by it. The servo-units are actuated by command signals through respective buses 212a,212b . . . 212n from a main micro-processor 214 and the buses also carry position information from the motors to the processor 214 so that deviations and errors can be monitored by the processor to provide a closed-loop control of the motions of the apparatus.

In an analogous way the micro-processor 214 issues command outputs 216 to pressure valve solenoids 218a,218b . . . 218n controlling supply conduits 220 to the pneumatic rams in the apparatus, here exemplified by the carriage discharging rams 102,108 and the carton ram 140. Each ram has position switches 224 and 226 at its opposite ends which are operated by the ram piston as it reaches the fully retracted or fully extended state and send a corresponding feedback signal through line 228 or 230 to the micro-processor.

The micro-processor program coordinates the operation of the electrical motors and pneumatic rams, as for example the synchronisation of the pusher ram 64 with the belt drive motors 70,72 and the motor 144 with the rams 102,108. As another example, in association with the article-producing apparatus there may be means 232 (FIG. 1) for ejecting substandard packets, for example in the form of a further ram, represented by the unit 232 shown in FIG. 1. The micro-processor is programmed to respond to the operation of the unit 232 to temporarily slow down or halt, with appropriate timing, that one of the motors 70,72 driving the pairs of belts on which the stack S is currently being collected so that the descent of the partly-built stack is matched to the arrival of individual articles at the chute and not merely to the speed of the conveyor belt 20 bringing the articles there. The arrival of successive packets T at the chute thus provides the actuating impulses that cause the control system to step through its programmed sequence as described above. The unit 232 or another unit placed near to entry to the chute may also comprise sensing means for the pallets, e.g. to ensure start-up of the collating apparatus in synchronisation with the start of the flow of packets.

The micro-processor 214 has further output lines 240a,240b . . . 240n for changeover valves (not shown) to actuate such functions as the application of vacuum (e.g. to the manifold block 116 and suction cups 124), and other drives. It may also have further inputs 250a,250b . . . 250n from additional (not shown) of, e.g., pressure, vacuum and proximity, to assist coordination of the functions of the parts of the apparatus, in particular through monitoring and safety override controls.

The erection of the cartons from card blanks, the placing of the open cartons in the conveyor carriage, the removal of the filled cartons and any subsequent packaging can all be performed by conventional means and are not described here.

The foregoing description of the invention with reference to the drawings is intended to be illustrative and many modifications can be made within the scope of the invention. For example, different means can be employed to generate the various motions; in particular the individual motors and rams may be replaced by a common drive means which generates the motions through respective cam and/or gear mechanisms.

We claim:

1. A collating apparatus for a stack of generally flat articles comprising a downwardly extending guide for containing the articles, an entry region at the upper end of the guide for receiving said articles into the guide, stack support means within said guide for supporting the articles as they are accumulated therein, said support means comprises two support arrangements each of which comprises a pair of conveyor bands extending downwardly in diagonally opposite positions at the sides of the guide downwardly from said upper entry region and engagement elements for the articles projecting from each said conveyor band across the face of that band of the other pair of bands on the same side of the guide and being downwardly displaceable with their respective conveyor bands, means for displacement of said support arrangements with the accumulation of said articles within the guide to at least partly compensate for the increasing height of the accumulating stack, take-off means for removing a completed stack from the guide, and means displaceable within the guide for engaging the top of the completed stack prior to its removal from the guide by said take-off means to compress the height of the stack in preparation for the insertion of the articles as a stack into a container.

2. Apparatus according to claim 1 wherein the support means comprises two support arrangements each of which comprises a pair of conveyor bands extending downwardly in diagonally opposite positions at the sides of the guide, engagement elements for the articles projecting from each band across the face of that band of the other pair of bands on the same side of the guide.

3. Apparatus according to claim 1 comprising means for retaining a planar partitioning element in the transfer device prior to the transfer of a stack of articles to said device.

4. A collating apparatus for a stack of generally flat articles comprising a downwardly extending guide for containing the articles as they are stacked together, support means within said guide extending downwardly from an upper entry region of the guide, said support means comprising two support arrangements each of which comprises a pair of conveyor bands extending downwardly in diagonally opposite positions at the sides of the guide, engagement elements for the articles projecting from each band across the face of that band of the other pair of bands on the same side of the guide to be disposed in overlapping relationship for respective stacks of articles, and respective driving means for driving said support arrangements at different rates from each other, said driving means including means for downwards displacement of the engagement elements of each said support arrangement with the accumulation of said articles within the guide upon said engagement elements of the respective said arrangement to at least partly compensate for the increasing height of said accumulating articles.

5. Apparatus according to claim 4 wherein means for ejecting a completed stack from the guide comprises an ejection member in the guide between the conveyor bands, a central space of said guide in which said member is disposed being between the paths of the said displacement of the engagement elements of the respective support arrangements.

6. Apparatus according to claim 4 comprising a transfer device for receiving a stack of articles from the guide, a filling station for the location of a container for said articles, and means for operating said transfer device to convey said stack of articles to the container.

7. Apparatus according to claim 4 comprising a transfer device for receiving a stack of articles from the guide, a filling station for the location of a container for said articles, means for operating said transfer device to convey said stack of articles to the container and drive means for relative displacement between the transfer device and the container to obtain the deposition of successive stacks in different regions of the container.

8. Apparatus according to claim 7 wherein means are provided to insert into the transfer device a partitioning element to be deposed in the container with a stack to separate successive stacks in the container.

9. Apparatus according to claim 4 wherein means are provided above said guide for impelling incoming articles downwardly onto the stack building in the guide, and means for the continuation in operation of said impelling means during the extraction of a completed stack.

10. A collating apparatus for a stack of generally flat articles comprising a downwardly extending guide for containing the articles as they are stacked together, support means within said guide extending downwardly from an upper entry region of the guide said support means comprising a plurality of support arrangements in overlapping relationship for respective stacks of articles and respective driving means for driving said support arrangements at different rates from each other, said driving means including means for downwards displacement of each said support arrangement with the accumulation of said articles within the guide upon the respective said arrangement to at least partly compensate for the increasing height of said accumulating articles, a transfer device for receiving each completed stack of articles from the guide, a filling station for the location of a container for said articles, means for operating said transfer device to convey said stack of articles to the container and drive means for relative displacement between the transfer device and the container to obtain the deposition of successive stacks in different regions of the container.

11. Apparatus according to claim 10 wherein the engagement elements mounted on said conveyer bands extend from opposite sides of the guide, and a central zone of the guide is clear of the paths of displacement of said elements, stack ejection means being locatable in said central zone for the ejection of the completed stack.

12. Apparatus according to claim 10 comprising a transfer device for receiving a stack of articles from the guide, a filling station for the location of a container for said articles, means for operating said transfer device to convey said stack of articles to the container, and wherein the transfer device comprises at least one pair of carriages registrable simultaneously with the guide and the filling station respectively to deposit one stack at the filling station and accept a further stack from the guide.

13. Apparatus according to claim 12 wherein a pivot mounting on which the transfer device is mounted has an inclined axis about which the transfer device is rotationally displaceable, and said pair of carriages are in opposed and oppositely inclined positions relative to said rotary axis whereby to reposition each stack from a downwardly extending orientation to a downwardly facing orientation for placing in the container.

14. A collating apparatus for a stack of flat packets comprising guide means for collecting individual packets into a stack and a feed means for supplying the packets to the guide means, detection means operable on the packets on said feed means for detecting and removing reject packets from the feed means respective independent drive means for the feed means and for the guide means whereby the guide means are operable at a different rate from the feed means to compensate for the absence of packets diverted from the main flow of packets said removal means being arranged to trigger a compensating delay in the operation of the guide means when a packet is removed by said detection means.

15. A collating apparatus for a stack of generally flat articles comprising a downwardly extending guide for containing the articles as they are stacked together, support means within said guide extending downwardly from an upper entry region of the guide said support means comprising a plurality of support arrangements in overlapping relationship for respective stacks of articles and respective driving means for driving said support arrangements at different rates from each other, said driving means including means for downwards displacement of each said support arrangement with the accumulation of said articles within the guide upon the respective said arrangement to at least partly compensate for the increasing height of said accumulating articles, a transfer device for receiving a stack of articles from the guide, a filling station for the location of a container for said articles, means for operating said transfer device to convey said stack of articles to the container and drive means for relative displacement between the transfer device and the container to obtain the deposition of successive stacks in different regions of the container, and means for insertion into the transfer device of partitioning element to be deposed in the container with a stack for the separation of successive stacks in the container.

16. A collating apparatus for a stack of generally flat articles comprising a downwardly extending guide for containing the articles as they are stacked together, support means within said guide extending downwardly from an upper entry region of the guide said support means comprising a plurality of support arrangements in overlapping relationship for respective stacks of articles and respective driving means for driving said support arrangements at different rates from each other, said driving means including means for downwards displacement of each said support arrangement with the accumulation of said articles within the guide upon the respective said arrangement to at least partly compensate for the increasing height of said accumulating articles, a transfer device for receiving a stack of articles from the guide, a filling station for the location of a container for said articles, means for operating said transfer device to convey said stack of articles to the container at said filling station, and wherein the transfer device comprises at least one pair of carriages registrable simultaneously with the guide and the filling station respectively to deposit one stack at the filling station and accept a further stack from the guide.

* * * * *